US006919050B2

(12) United States Patent
Hettwer et al.

(10) Patent No.: US 6,919,050 B2
(45) Date of Patent: Jul. 19, 2005

(54) METHOD AND ARRANGEMENT FOR SUPPLYING A WASTE HEAT EXCHANGER WITH EXHAUST GAS FROM A GAS TURBINE

(75) Inventors: Martin Hettwer, Beckum (DE); Udo Feistel, Gummerabach (DE); Roy Swart, Rijswljk (NL)

(73) Assignee: NEM Power Systems (DE)

( * ) Notice: Subject to any disclaimer, the term of this patent is extended or adjusted under 35 U.S.C. 154(b) by 832 days.

(21) Appl. No.: 09/834,304

(22) Filed: Apr. 11, 2001

(65) Prior Publication Data

US 2002/0001549 A1 Jan. 3, 2002

(30) Foreign Application Priority Data

Apr. 11, 2000 (DE) ..... 100 17 987

(51) Int. Cl.[7] ..... F01N 3/08
(52) U.S. Cl. ..... 422/176; 422/168
(58) Field of Search ..... 422/176, 168, 422/169

(56) References Cited

U.S. PATENT DOCUMENTS 2,627,717 A * 2/1953 Waller ..... 60/39.17
2,863,644 A * 12/1958 Fallon ..... 165/5
3,339,663 A * 9/1967 Anderson ..... 180/304
3,442,324 A * 5/1969 Clay, Jr. et al. ..... 165/283
5,002,121 A * 3/1991 von Erichsen ..... 165/100

FOREIGN PATENT DOCUMENTS

| | | |
|---|---|---|
| DE | 43 19 732 | 12/1994 |
| DE | WO 94/29643 | 12/1994 |
| DE | 197 37 507 | 3/1999 |
| GB | 2 261 474 | 5/1993 |
| JP | 03206325 | 9/1991 |

* cited by examiner

*Primary Examiner*—M. Alexandra Elve
(74) *Attorney, Agent, or Firm*—Robert W. Becker & Associates; Robert W Becker

(57) ABSTRACT

A method and arrangement for supplying a waste heat exchanger with exhaust gas from a gas turbine are provided. The exhaust gas is guided through a diverter having a pivotable butterfly valve. When the valve is opened for initial entry of gas into the exchanger, the gas flows about the free edge of the valve. At least during initial entry of gas into the exchanger, the stream of gas is at least partially deflected downstream of the butterfly valve. This deflection is preferably eliminated after the initial entry of gas into the exchanger.

8 Claims, 1 Drawing Sheet

METHOD AND ARRANGEMENT FOR SUPPLYING A WASTE HEAT EXCHANGER WITH EXHAUST GAS FROM A GAS TURBINE

BACKGROUND OF THE INVENTION

The present invention relates to a method and arrangement for supplying a waste heat boiler or exchanger with exhaust gas from a gas turbine, whereby the gas is guided through a diverter having a pivotable butterfly valve, and whereby when the valve is opened to initiate entry of exhaust gas into the waste heat exchanger, the gas flows about the free edge of the valve.

During start up of the waste heat exchanger, which is disposed downstream of a gas turbine and a diverter, due to different thermal loads localized critical material stresses occur in the components of the exchanger; these are caused by localized concentrations of higher temperature in the exhaust gas that is supplied. These concentrations are produced by partial opening of the diverter as exhaust gas flows over the free edge of the butterfly valve, possibly in conjunction with the gas turbine swirl imparted to the gas flow. Accordingly, when a diverter is used, which upon demand can convey the exhaust gas of the gas turbine to a bypass flue, the exchanger components become costly with regard to wall thickness, curved expansion sections, and control means.

It is therefore an object of the present invention to provide a method and arrangement of the aforementioned general type according to which the waste heat exchanger can have a far less expensive configuration.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

The method of the present invention is characterized primarily by at least partially deflecting a stream of the exhaust gas downstream of the butterfly valve, at least during initial entry of gas into the waste heat exchanger. As the exchanger starts up, pursuant to the present invention an equalizing distribution of the local concentrations is achieved over the in-flow cross-sectional area of the waste heat exchanger, so that the exchanger components can be designed for considerably lower stresses.

Due to the deflection of the exhaust gas, an additional pressure loss is generated in the exchanger operation. This pressure loss can be reduced if after start up of the waste heat exchanger, with the butterfly valve opened, the deflection downstream of the butterfly valve is again essentially discontinued or eliminated.

The method of the present invention can also be utilized in order, for example, to achieve an improved flow to a sound dampener that is disposed in a bypass flue that extends from the diverter.

As indicated above, the present invention is also directed to an arrangement for supplying a waste heat exchanger with exhaust gas from a gas turbine, whereby a diverter having a pivotable butterfly valve is disposed between the exchanger and the gas turbine.

Pursuant to the inventive arrangement, a guide mechanism is disposed downstream of the pivotable butterfly valve and has at least one guide plate for the at least partial deflection of the gas stream during initial entry of gas into the waste heat exchanger.

The at least one guide plate is preferably pivotably mounted so that after start up of the exchanger, with the diverter opened, as low a pressure loss as possible can be achieved.

In addition, a second guide mechanism, with at least one guide plate, can be disposed in the bypass that proceeds from the diverter for the at least partial deflection of the flow in the bypass.

Further specific features of the present invention will be described in detail subsequently.

DESCRIPTION OF PREFERRED EMBODIMENTS

Figure 1:
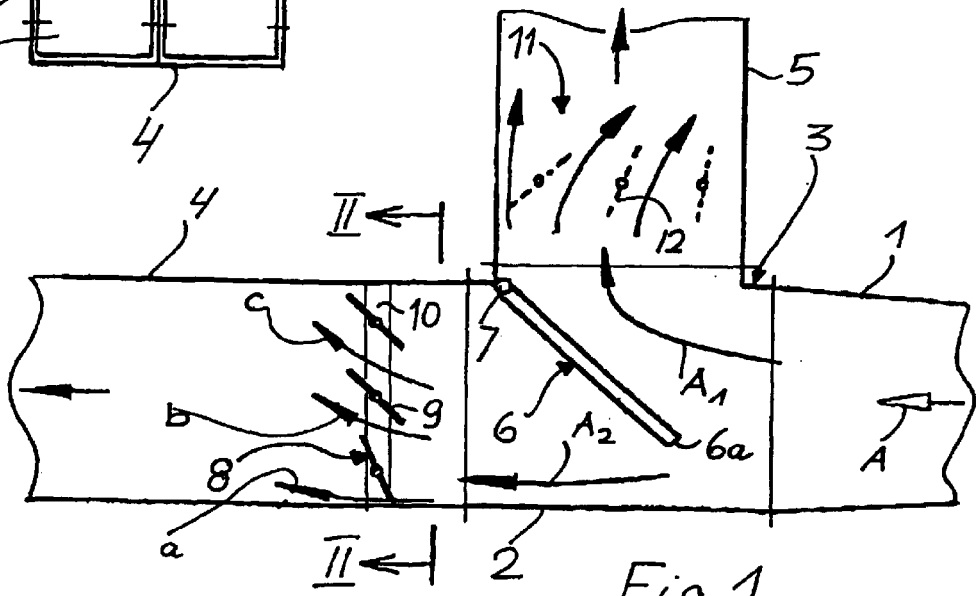
FIG. 1 shows one exemplary embodiment of an inventive arrangement, whereby the butterfly valve of the diverter, and the guide plates of the guide mechanism, are in the control position "initial entry into exchanger"

Referring now to the drawing in detail, as shown in FIG. 1, by means of a channel 1 that widens in the direction of flow exhaust gas A from a non-illustrated gas turbine is conveyed to the housing 2 of a diverter 3. On that side remote from the channel 1, the diverter 3 is connected to a channel 4 that conveys the exhaust gas A to a non-illustrated waste heat boiler or exchanger. Branching off from the housing 2 is a bypass channel 5 that leads to a non-illustrated bypass flue. In the diverter housing 2, a butterfly valve or damper 6 is pivotably mounted about a horizontal shaft 7 in such a way that it can block off either the channel 4 or the channel 5 while being able to maintain various intermediate positions. In the position illustrated in FIG. 1, a portion $A_1$ of the exhaust gas A conveyed from the gas turbine enters the bypass channel 5, while another portion $A_2$ flows about the free edge 6*a* of the butterfly valve.

As the stream $A_1$ flows about the edge 6*a*, localized concentrations occur in the stream and under certain circumstances are enhanced by the swirl imparted by the gas turbine. The formation of concentrations in the stream $A_2$ leads to a nonuniform thermal stress of the cross-sectional area of the channel 4, and hence of the non-illustrated waste heat exchanger.

Disposed in a known manner between the housing 2 and the channels 4 and 5 are non-illustrated compensators.

Figure 2:
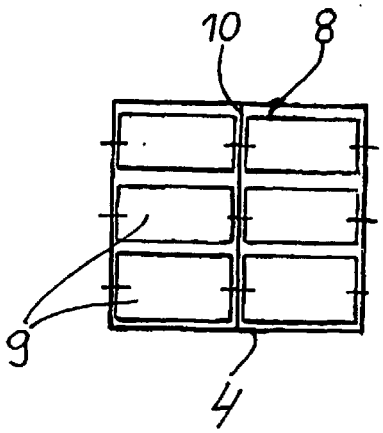
FIG. 2 is a cross-sectional view taken along the line II—II in FIG. 1.

Pursuant to the present invention, a guide mechanism 8 is disposed in the in-flow end of the channel 4. This guide mechanism is provided with six guide plates 9, which are each pivotable about a horizontal shaft and are disposed in a vertical cross-sectional plane. The guide plates 9 are disposed next to one another in two rows, and could be separately moveable relative to one another. A carrier member 10 is also disposed in the channel 4 for the concentric mounting of the guide plates 9. In the embodiment illustrated in FIGS. 1 and 2, the shafts are centrally disposed. However, an eccentric arrangement would also be possible.

The guide mechanism 8 covers the entire cross-sectional area of the channel 4. However, it is also possible to only partially cover the total cross-sectional area as a function of the concentration distribution in the stream $A_2$. For example, a guide mechanism can be provided that has only the four lower guide plates 9 of FIG. 2.

As can be seen from FIG. 1, the pivot angle of the individual guide plates 9 can be set independently of one another in order to be able to better adapt the necessary deflection to the given concentration configuration.

The adjustment mechanisms for the butterfly valve 6 and the guide plates 7 are not illustrated. However, from a control standpoint such mechanisms can be combined in such a way that the guide plates 9 are pivoted as a function of the pivoting of the butterfly valve 6.

During initial entry of gas into the exchanger, the guide plates 9 assume the positions illustrated in FIG. 1, as a result of which the stream $A_2$ is essentially divided into three partial streams a, b and c, whereby the partial streams b and c are deflected to a greater extent. In this way, the gas stream $A_2$ is divided more uniformly over the cross-sectional area of the channel 4.

Figure 4:
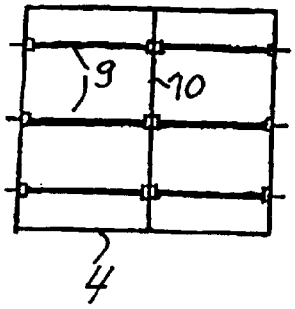
FIG. 4 is a cross-sectional view taken along the line IV—IV in FIG. 3.
Figure 3:
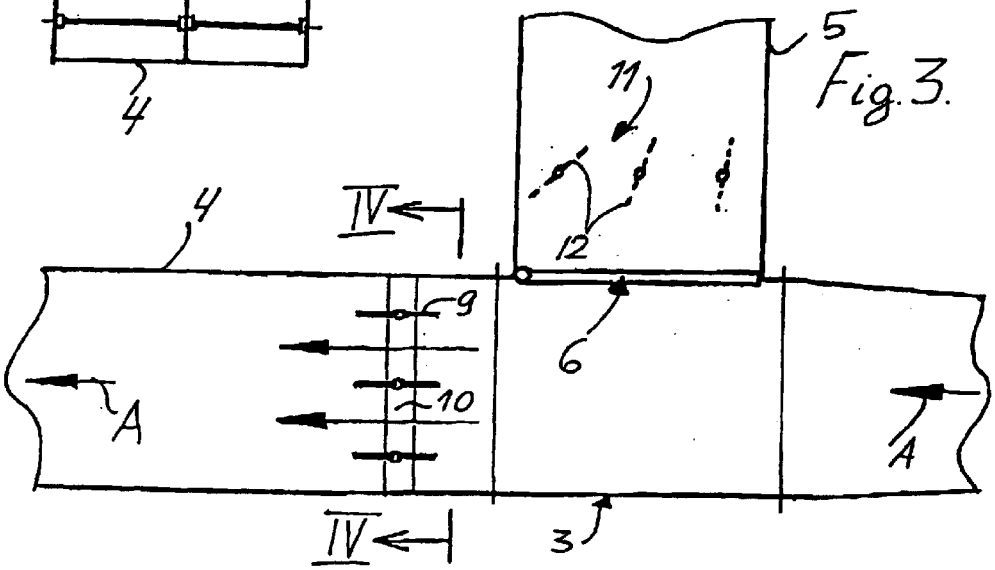
FIG. 3 is an arrangement similar to that of FIG. 1 with the butterfly valve of the diverter, and the guide plates of the guide mechanism, being in the open position "exchanger operation"

After conclusion of the starting process, the butterfly valve 6 blocks off the bypass channel 5 and the guide plates 9 assume the position illustrated in FIGS. 3 and 4; in this position, the gas stream A conveyed from the turbine flows to the waste heat exchanger without being deflected in the guide mechanism 8. In this position, the guide mechanism generates no appreciable pressure loss.

In the illustrated embodiment, the guide mechanism 8 is built into the channel 4. It is also conceivable, with an appropriate configuration of the valve housing 2, to build the guide mechanism into such housing.

In the embodiment of FIGS. 1 to 4, a guide mechanism 11 that is comparable to the guide mechanism 8 is disposed in the bypass channel 5; the guide mechanism 11 can, for example, improve flow to a sound dampener that is disposed in the bypass channel 5 or the subsequent bypass flue. The guide plates 12 can be adjustable, possibly independently of one another.

The guide plates need not be rectangular, as is the case with the embodiment of FIGS. 1 to 4. Rather, the guide plates could also be circular or oval, since the critical thing is only the equalization of the thermal concentrations but not a blocking of the flow cross-section by the guide plates. A lesser number of guide plates could also be utilized. Under certain circumstances, a single guide plate could be sufficient.

The specification incorporates by reference the disclosure of German priority document DE 100 17 987.8 of Apr. 11, 2000.

The present invention is, of course, in no way restricted to the specific disclosure of the specification and drawing, but also encompasses any modifications within the scope of the appended claims.

What we claim is:

1. A method of supplying a waste heat exchanger with exhaust gas from a gas turbine, comprising the following steps:

allowing the exhaust gas flowing from the gas turbine to pass through a diverter that has a pivotable butterfly valve;

opening the pivotable butterfly valve to initiate entry of gas into the waste heat exchanger;

allowing the exhaust gas to flow about a free edge of the pivotable butterfly valve;

deflecting at least partially a stream of the exhaust gas into the waste heat exchanger; and discontinuing or eliminating deflection downstream of the pivotable butterfly valve after initial entry of the exhaust gas into the waste heat exchanger.

2. An arrangement for supplying a waste heat exchanger with exhaust gas from a gas turbine, comprising:

a diverter disposed between a gas turbine and a waste heat exchanger, wherein the diverter is provided with a pivotable butterfly valve capable of blocking gas flow to said diverter or alternately, said gas turbine, or alternately partially diverting a flow to either of said diverter or said gas turbine; and a guide mechanism disposed downstream of the pivotable butterfly valve for at least partially deflecting a stream of the exhaust gas during initial entry of the exhaust gas into the waste heat exchanger, wherein the guide mechanism is provided with at least one guide plate, and wherein the at least one guide plate is pivotable between a deflection position and a position that essentially does not affect the exhaust gas flow.

3. An arrangement according to claim 2, wherein a bypass extends from said diverter, and wherein a further guide mechanism having at least one guide plate is disposed in said bypass for the at least partial deflection of a flow in said bypass.

4. An arrangement according to claim 2, wherein said guide mechanism extends over the entire cross-sectional flow area.

5. An arrangement according to claim 2, wherein said guide mechanism extends over only a portion of a cross-sectional flow area.

6. An arrangement according to claim 2, wherein said guide mechanism has a single guide plate that is rectangular, circular or oval.

7. An arrangement according to claim 2, wherein said guide mechanism is provided with a plurality of guide plates.

8. An arrangement according to claim 7, wherein said guide plates are adjustable independently of one another.

* * * * *